US005784086A

United States Patent [19]

Hayao

[11] Patent Number: 5,784,086

[45] Date of Patent: Jul. 21, 1998

[54] INK CARTRIDGE HOLDING BOX FOR REFILLING

[75] Inventor: Sakae Hayao, Chatsworth, Calif.

[73] Assignee: Mitsubishi Pencil Corporation of America, Chatsworth, Calif.

[21] Appl. No.: 408,916

[22] Filed: Mar. 22, 1995

[51] Int. Cl.[6] ..... B41J 2/175

[52] U.S. Cl. ..... 347/85

[58] Field of Search ..... 347/87, 86, 29, 347/85, 84

[56] References Cited

U.S. PATENT DOCUMENTS

| | | | |
|---|---|---|---|
| 5,329,294 | 7/1994 | Ontawar . | |
| 5,495,877 | 3/1996 | Schwenk et al. | 141/370 |

FOREIGN PATENT DOCUMENTS

| | | | |
|---|---|---|---|
| 523637-A1 | 1/1993 | European Pat. Off. | 347/87 |
| 567308-A2 | 10/1993 | European Pat. Off. | 347/87 |
| 4-247954 | 9/1992 | Japan | 347/29 |

*Primary Examiner*—Benjamin R. Fuller
*Assistant Examiner*—Judy Nguyen
*Attorney, Agent, or Firm*—Koda & Androlia

[57] ABSTRACT

An ink cartridge holding box used for refilling a used ink cartridge with ink having an adhesive layer on a platform installed inside the box. The central area of the adhesive layer is raised by, for example, a spacer provided under the adhesive layer so that the adhesive layer is in a convex shape, conforming to any unevenness of the underside of the used ink cartridge and sealing the vent hole opened in the underside of the cartridge.

5 Claims, 3 Drawing Sheets

INK CARTRIDGE HOLDING BOX FOR REFILLING

BACKGROUND OF THE INVENTION

1. Field of the Invention

The present invention relates to an ink cartridge holding box and more particularly to a box for holding a used ink cartridge for refilling the cartridge with ink.

2. Prior Art

When the ink in an ink cartridge for a computer printer is used up, a new ink cartridge is set in the printer. Recently, however, it has been practiced that an empty ink cartridge is refilled with ink so that the refilled ink cartridge can be used repeatedly for several times.

The refilling of ink into ink cartridges is currently performed in several different ways. One of them is that a used, empty cartridge is set in a cartridge holding casing that has a top cover so that the empty ink cartridge is entirely put in the casing for receiving the ink. Another way of refilling ink is performed using a jig or cartridge stand. This manner of holding an ink cartridge is disclosed, for example, in the U.S. Pat. No. 5,329,294. In the device of this prior art, the ink cartridge is held by a C-shaped clamp extending from a jig that stands vertically. However, since the cartridge is held between two ends of the clamp in a lifted position, the cartridge tends to be inclined during the use. In other words, since the cartridge is held only by two points which are at both ends of the C-shaped clamp, the cartridge cannot be held in a stable manner and ink spillage occurs often.

The inventor of the present application has previously filed an application for an ink refill kit (Ser. No. 08/378,975) that includes an ink holding box. With this ink holding box, a used cartridge is held well in a relatively shallow box by an adhesive material so that ink refilling is performed with the cartridge standing upright. Since the ink cartridge can stably sit in the box, the ink cartridge does not incline and no ink spillage occurs. However, it was found that due to an uneven surface pattern formed on the underside of an ink cartridge, the ink cartridge on a rare occasion becomes loosened on the adhesive material.

Furthermore, when the ink refill act is performed, it is required to seal the vent hole that is opened in the underside of an ink cartridge. The sealing is presently accomplished by, for example, applying a rubber plug into the vent hole or by covering the hole with a plastic tape. However, since the vent hole is surrounded by a labyrinth-like pattern which is uneven or partially projects from the underside of the cartridge, a sealing of the vent hole with such means is not accomplished well, causing a leakage of ink from the vent hole.

SUMMARY OF THE INVENTION

Accordingly, it is a primary object of the present invention to solve the problems seen in the prior art ink refilling process and provide an improved ink cartridge holding box with which the vent hole of the cartridge can be sealed well and the ink cartridge can stand still without getting loosened or becoming unstable, thus assuring an efficient and clean ink refilling process.

The above and other objects of the present invention is accomplished by a unique structure for an ink cartridge holding box that includes a resilient convex shape adhesive layer provided on a platform of the holding box so that when a used ink cartridge is pressed against the adhesive layer, the convex adhesive layer can comply with any surface configuration and particularly the uneven underside of the ink cartridge.

With this unique structure, an empty cartridge can be placed in the cartridge holding box in a positionally well secured fashion with the vent hole completely sealed by being adhered by the convex shape adhesive layer, thus assuring that the ink refill act is performed easily and efficiently with an additional advantage that the area around the refilling job can be kept clean.

DETAILED DESCRIPTION OF THE INVENTION

Figure 1:
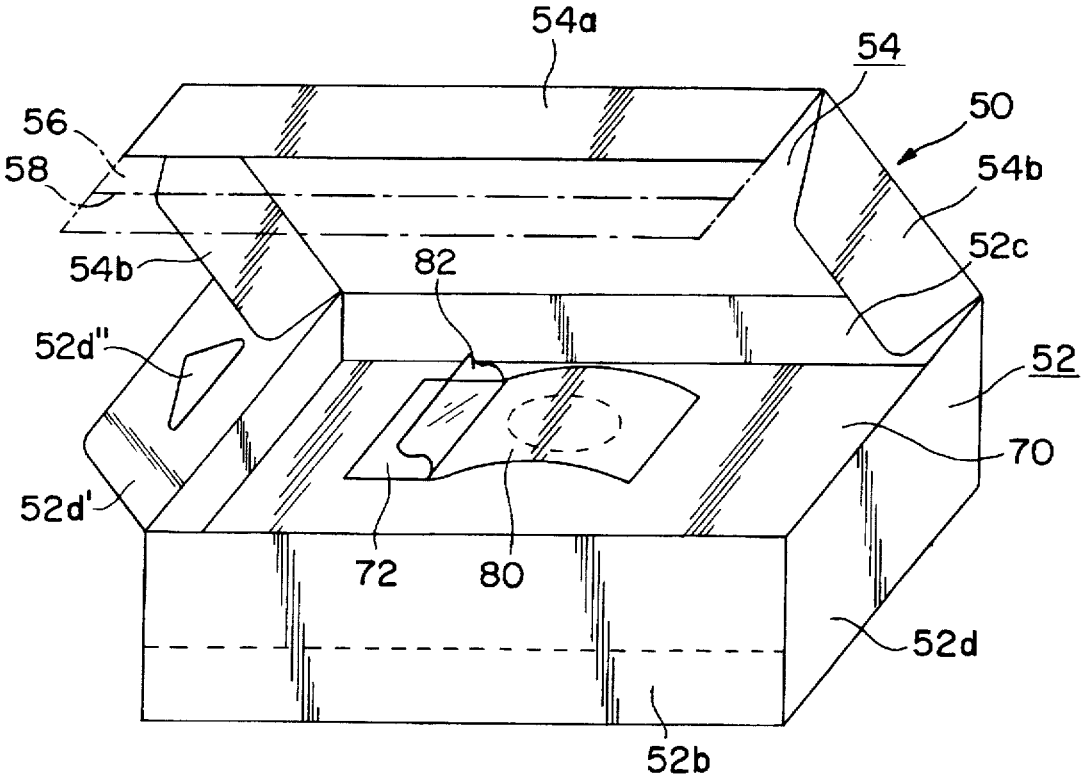
FIG. 1 shows a perspective view of the ink cartridge holding box according to one embodiment of the present invention.
Figure 2:
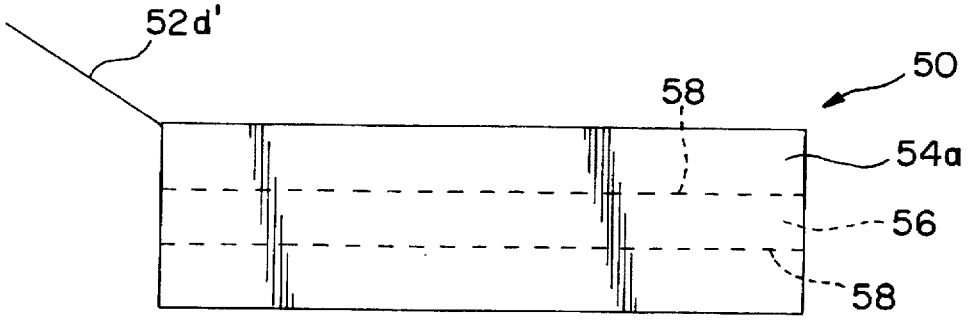
FIG. 2 shows a front view of the cartridge holding box with the cover section thereof closed.

The cartridge holding box 50 is made of durable paper with water-proof treatment thereon and includes a main box section 52 and a cover section 54.

The main box section 52 includes a bottom plate 52*a*, front wall 52*b*, rear wall 52*c* and two side walls 52*d*. The cover section 54 extends from the upper edge of the rear wall 52*c* so as to open and close in a hinge-like fashion. The cover section 54 has a front flap 54*a* and two side flaps 54*b*. The front flap 54*a* is provided with a tab 56 that is peelable along perforations 58 formed on both sides of the tab 56. During the assembly of the box 50, the front flap 54*a* of the cover section 54 is glued to the outside surface of the front wall 52*b* of the main box section 52 with the side flaps 54*b* both inside the main box section 52. When the box 50 is used as will be described below, the tab 56 is removed along the perforations 58 so that the cover section 54 can be opened.

One of the side walls 52*d* of the main box section 52 may have a hanging flap 52*d'* with a hole 52*d"* therein so that the box 50 can be hanged from, for example, a display stand.

On the upper surface of the bottom plate 52*a* of the main box section 52 is securely provided an absorbing sheet 52*b'*, and on this absorbing sheet 52*b'* is a supporting block 60. The supporting block 60 is made of, for example, cotton that is formed into a relatively flat block shape. In other words, it is preferable that the supporting block 60 is made of a liquid absorbent material so that any spilled ink can be absorbed by the supporting block 60 and the absorbing sheet 52*b'*. The supporting block 60 is size-wise about one half of the bottom plate 52*a*.

On this supporting block 60, a platform 70 which is as large in size as the bottom plate 52*a* is provided, and an empty space 62 is left on one side underneath the platform 70. The platform 70 is provided with a rectangular opening 72 that opens into the empty space 62. The opening 72 is substantially the same as or slightly larger than the projected portion 102 of an ink cartridge 100.

On the upper surface of the platform 70 and next to the rectangular opening 72 is provided with an adhesive layer 80. The adhesive layer 80 consists of an adhesive agent such as a self adhesive tacky substance, pressure sensitive contact adhesive, etc. and is covered by a removable thin sheet of plastic film 82. The adhesive layer 80 is as large in size as the underside 104, on which an vent hole 106 and an uneven labyrinth pattern 108 are formed, of the ink cartridge 100.

Figure 3:
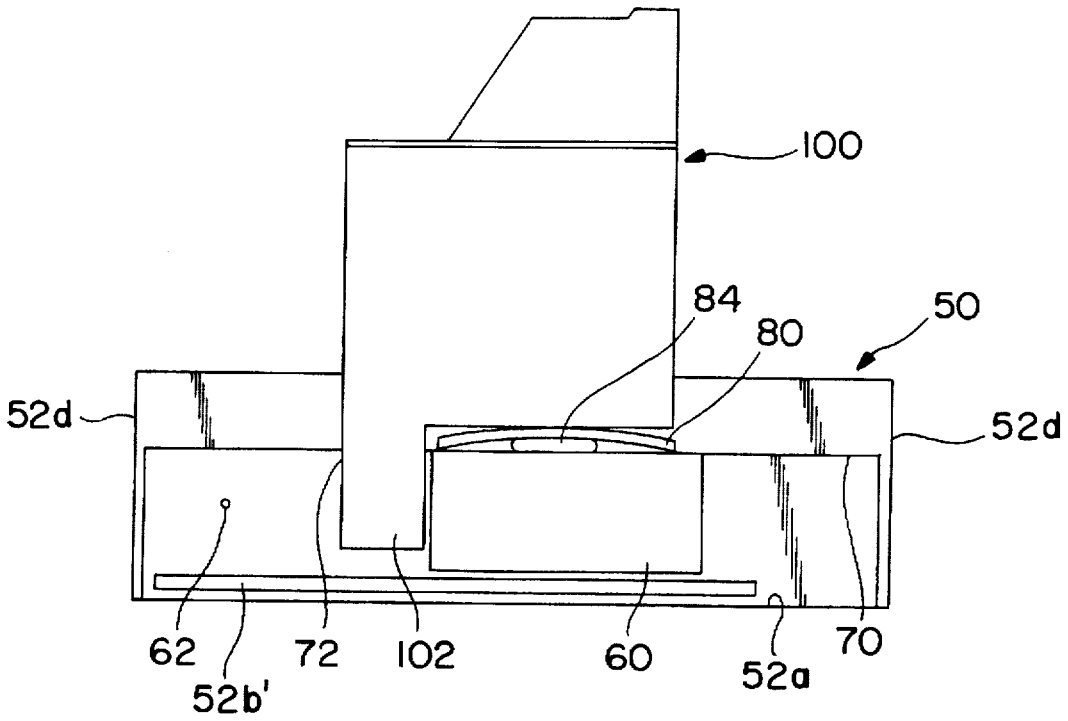
FIG. 3 shows a cross section of the cartridge holding box with an ink cartridge set inside.
Figure 4:
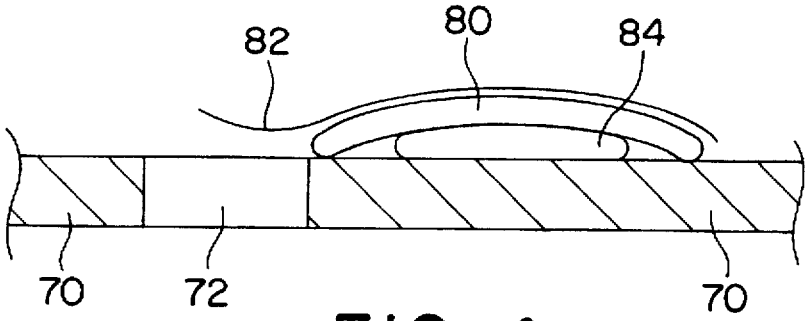
FIG. 4 is an enlarged cross section showing the adhesive layer on the platform provided in the cartridge holding box.

In addition, a spacer 84 is provided underneath the adhesive layer 80. The spacer 84 is made of any material that can compensate for or absorb the unevenness on the surface pattern of the underside 104 of the cartridge 100. More specifically, the spacer 84 is, for example, a round thin plate with a thickness of 0.05 mm to 0.2 mm and made of a material such as rubber, plastics, etc. The spacer 84 is installed so that it is at substantially the central area of the adhesive layer 80. With this spacer 84 inserted between the adhesive layer 80 and the platform 70, the adhesive layer 80 forms substantially a convex shape when viewed from the side as seen in FIGS. 3 and 4.

Figure 5:
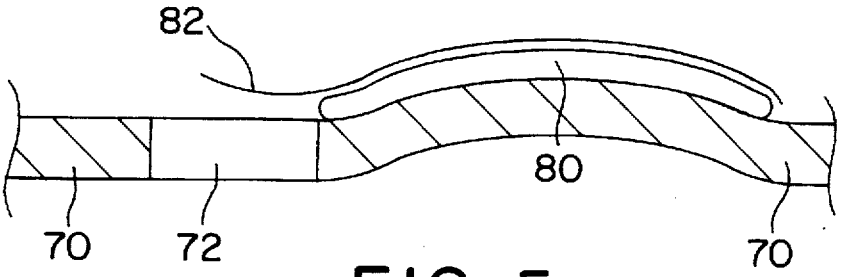
FIG. 5 is an enlarged cross section showing the adhesive layer on the platform provided in the cartridge holding box according another embodiment of the present invention.
Figure 6:
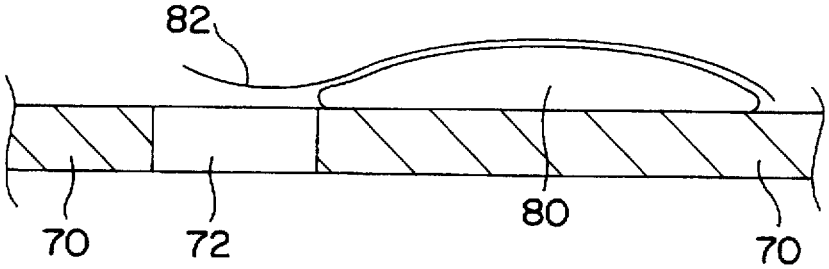
FIG. 6 is an enlarged cross section showing the adhesive layer on the platform provided in the cartridge holding box according still another embodiment of the present invention.
Figure 7:
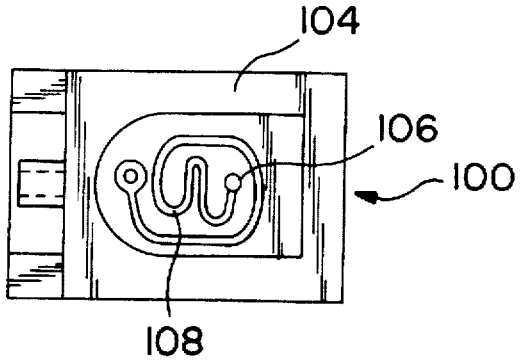
FIG. 7 shows the underside of the ink cartridge.

The convex shape in the adhesive layer 80 can be obtained by bending upward a portion of the platform 70 that corresponds to substantially the central area of the adhesive layer 80 as seen in FIG. 5. Furthermore, the same convex configuration may be obtained by applying an excess amount of the adhesive substance at the central area of the adhesive layer 80 on the flat platform 70 as seen in FIG. 6.

In use, the cartridge holding box 50 is placed on a flat surface after removing the tab 56 along the perforations 58, and then the plastic film 82 is removed from the adhesive layer 80. The projected portion 102 of the cartridge 100 is pushed down into the opening 72 of the platform 70 that is installed in the cartridge holding box 50.

When the projected portion 102 of the cartridge 100 is pushed down, the underside 104 of the cartridge 100 is pressed against the adhesive layer 80 which is provided on the platform 70. As a result, the ink cartridge 100 is firmly held by the adhesive layer 80 and stands upright with the help of the opening 72 into which the projected portion 102 of the cartridge 100 is pushed. Thus, the cartridge 100 is thus stably held inside the cartridge holding box 50 without moving horizontally nor vertically.

When the cartridge 100 is thus firmly held by the adhesive layer 80, the convex shape adhesive layer 80 is flattened evenly and spreads out so as to seal a vent hole 106 and conforms with the unevenness or roughness of the underside 104 of the cartridge 100. Thus, the unevenness of the underside 104 of the ink cartridge 100 is balanced out and the entire underside 104 of the ink cartridge 100 is evenly adhered to the adhesive layer 80. As a result, the cartridge 100 is held inside the cartridge holding box 50 stably and the ink refill act can be easily and cleanly performed on this firmly held cartridge 100 that is free of any looseness and free of any leakage.

After refilling the thus held cartridge 100 with ink, the cartridge 100 is removed from the adhesive layer 80, taken out of the holding box 50 and then set in an ink jet printer.

The embodiments described above are to be considered in all respects as illustrative and not restrictive. The scope of the invention is indicated by the appended claims rather than the foregoing description, and all changes which come within the meaning and range of equivalency of the claims are, therefore, intended to be embraced therein.

I claim:

1. An ink cartridge holding box used while refilling ink into a used empty ink cartridge having a projected portion, said ink cartridge holding box comprising:

a main box section;

a supporting block provided on an inside upper surface of a bottom of said main box section;

a platform element provided on top of said supporting block so as to be spaced apart from said upper surface of said bottom of said main box, said platform element being formed with an opening into which said projected portion of said ink cartridge is inserted; and an adhesive layer for holding said ink cartridge, said adhesive layer being provided on an upper surface of said platform element so as to be located next to said opening.

2. An ink cartridge holding box according to claim 1, further comprising a spacer installed between said adhesive layer and said platform so as to form said adhesive layer into a convex shape.

3. An ink cartridge holding box according to claim 1, wherein a part of said platform positionally corresponding to a central area of said adhesive layer is bent upwardly so as to form adhesive layer into a convex shape.

4. An ink cartridge holding box according to claim 1, wherein an excess amount of adhesive substance is applied at a central area of said adhesive layer so as to form said adhesive layer into a convex shape.

5. An ink cartridge holding box according to claim 1, further comprising a cover section connected to said main box section so as to open and close in a hinged fashion.

* * * * *